United States Patent [19]

Müller

[11] 4,447,052

[45] May 8, 1984

[54] APPARATUS FOR SELECTIVELY TRANSPORTING A STREAM OF PAPER SHEETS OR THE LIKE FROM A FIRST PATH INTO ONE OF SEVERAL ADDITIONAL PATHS

[75] Inventor: Hans Müller, Zofingen, Switzerland

[73] Assignee: Grapha-Holding AG, Hergeswil, Switzerland

[21] Appl. No.: 441,227

[22] Filed: Nov. 12, 1982

Related U.S. Application Data

[63] Continuation of Ser. No. 196,176, Oct. 14, 1980, abandoned.

[30] Foreign Application Priority Data

Oct. 23, 1979 [CH] Switzerland ..... 477/79

[51] Int. Cl.[3] ..... B65H 29/66

[52] U.S. Cl. ..... 271/280; 271/227; 271/237; 271/245; 271/258; 271/303

[58] Field of Search ..... 271/151, 237, 244, 245, 271/256, 257, 279, 280, 303, 305, 227, 258

[56] References Cited

U.S. PATENT DOCUMENTS 3,623,722 11/1971 Sjogren ..... 271/303
3,866,902 2/1975 Feldkamper ..... 271/303
4,235,434 11/1980 Muller ..... 271/280

FOREIGN PATENT DOCUMENTS 2330614 1/1975 Fed. Rep. of Germany ..... 271/303

*Primary Examiner*—Richard A. Schacher
*Attorney, Agent, or Firm*—Peter K. Kontler

[57] ABSTRACT

Apparatus for transporting a scalloped stream of paper sheets from a first horizontal path into an aligned second horizontal path or into a downwardly sloping third path has a flap which is pivotable in a gap separating the first and second paths between a first position of coplanarity with the first and second paths so that the stream can enter the second path by traveling along the upper side of the flap and a second position in which the flap extends above the first and second paths to block the entry of the stream into the second path while permitting the stream to advance from the first into the third path. An intercepting plate is moved across the discharge end of the first path prior to pivoting of the flap from the first to the second position to temporarily prevent (e.g., for an interval of a few milliseconds) the advancement of sheets beyond the first path. This enables the last (partly overlapped) sheet of a preceding portion of the stream to enter the second path before the foremost sheet of the next portion of the stream is permitted to enter the third path. The intervals of blocking of the first path are sufficiently short to prevent the gathering of several sheets immediately behind the intercepting plate during blocking of the discharge end of the first path.

24 Claims, 4 Drawing Figures

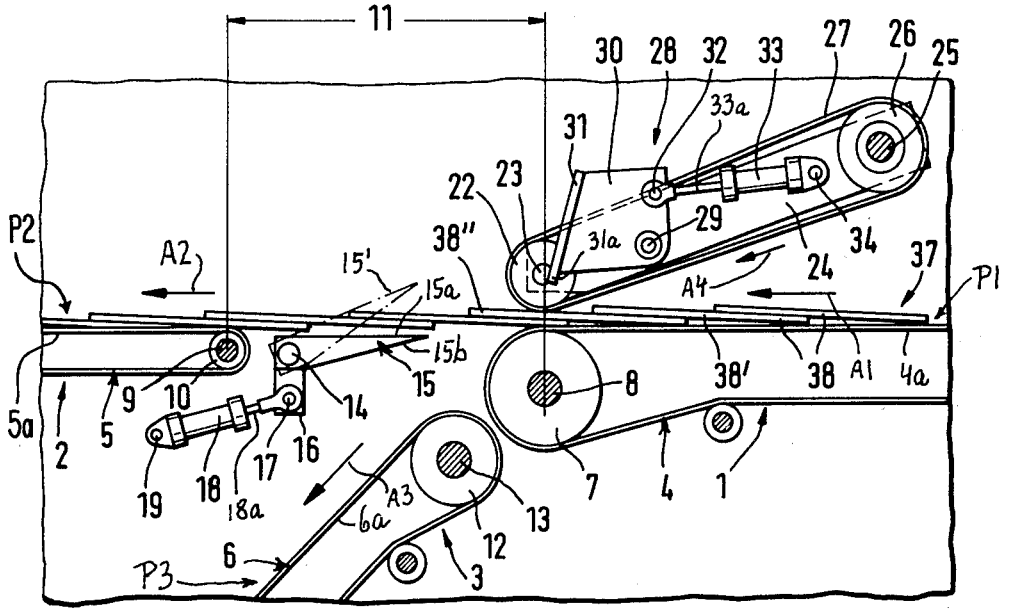
FIG. 1
FIG. 2
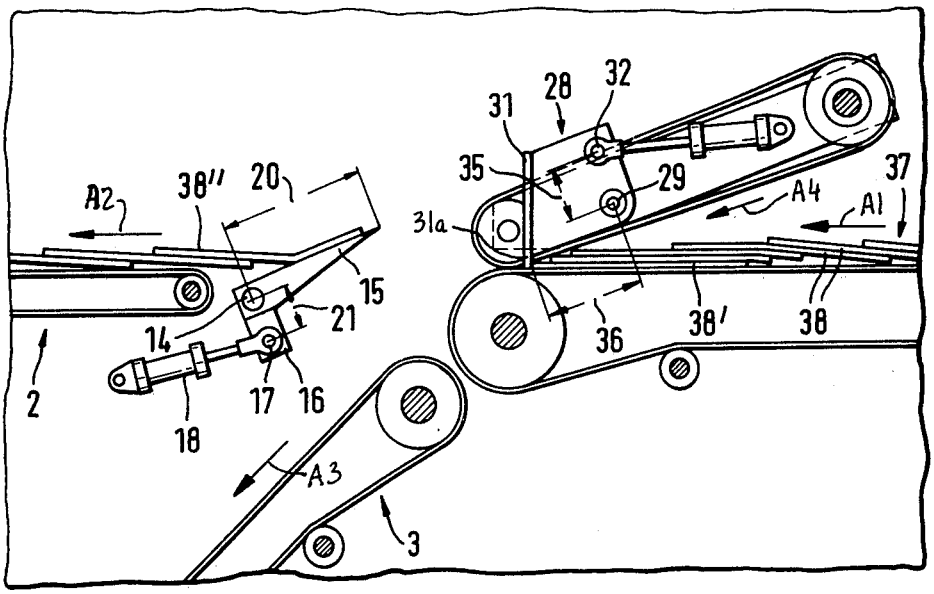

APPARATUS FOR SELECTIVELY TRANSPORTING A STREAM OF PAPER SHEETS OR THE LIKE FROM A FIRST PATH INTO ONE OF SEVERAL ADDITIONAL PATHS

This application is a continuation of application Ser. No. 196,176, filed Oct. 14, 1980, and now abandoned.

CROSS-REFERENCE TO RELATED CASE

The apparatus of the present invention can be used in machines of the type disclosed in the commonly owned copending application Ser. No. 908,546 filed by Hans Müller on May 22, 1978, now U.S. Pat. No. 4,235,434 granted Nov. 25, 1980. The disclosure of said commonly owned application is incorporated herein by reference.

BACKGROUND OF THE INVENTION

The present invention relates to improvements in apparatus for manipulating paper sheets or the like, and more particularly to improvements in apparatus for selectively transporting a stream of partly overlapping paper sheets or the like from a first path into one of several additional paths.

It is well known to assemble printed sheets, which issue from a printing machine and are thereupon folded in a folding machine, into a continuous stream wherein the sheets partly overlap each other (such stream is known as a scalloped stream). In a modern bookbinding plant, the scalloped stream is automatically transported to one or more further processing stations, for example, in a manner as disclosed in the aforementioned copending application Ser. No. 908,546. The transporting system normally comprises several belt or chain conveyors, and the junctions between the neighboring conveyors are provided with switching devices which enable a preceding conveyor to deliver sheets to any one of several next-following conveyors. For example, the preceding conveyor can deliver sheets to a first next-following conveyor which, in turn, delivers the sheets to a processing station, or to a second next-following conveyor which can deliver sheets into a magazine. It has been found that the heretofore known switching devices often present problems, especially when the scalloped stream is or should be transported at an elevated speed and the number of sheets which enter a selected additional path downstream of the (first) path along which the preceding conveyor delivers the sheets should not deviate from a predetermined number.

The apparatus which is disclosed in the copending application Ser. No. 908,546 comprises means for breaking up a continuous scalloped stream into discrete streams of identical length and containing identical numbers of partially overlapping sheets. Such discrete streams are manipulated not unlike the freight trains on the slidings of a railroad station. The apparatus includes switching devices which can divert discrete streams into different additional paths, for example, into additional paths preceding the magazines of various processing machines. The means for dividing a continuous scalloped stream into discrete streams of predetermined length includes a counter which actuates a braking device serving to engage the adjacent sheet of the continuous stream and to temporarily hold the engaged sheet against forward movement. The sheets which follow the engaged sheet pile up behind the braking device to form a stack which constitutes the leader of the respective discrete stream. A clearance or space develops between the sheet which is held by the braking device and the preceding sheet (i.e., the last sheet of the preceding discrete stream). The width of the clearance is determined in advance, i.e., it depends on the speed of the conveyor which delivers the continuous stream and on the length of the interval of engagement between a selected sheet and the braking device. A clearance is located in the region of the switch which follows the braking device (or in the region of a switch further downstream of the braking device) whenever the switch is moved to a different position to divert the freshly formed discrete stream into a selected path. The drawbacks of relatively wide clearances between successive discrete streams are numerous and serious. Thus, the leader of each discrete stream accumulates a relatively large number of fully or nearly fully overlapping sheets because such number is directly proportional to the width of the clearance between two successive discrete streams. The pileup at the leading end of a discrete stream is likely to cause problems during introduction of discrete streams into selected additional paths and may interfere with proper singularizing of sheets in the processing machines which follow. On the other hand, presently known switches cannot operate properly unless the width of the clearances between neighboring (successive) discrete streams at least approximates a predetermined minimum value which is sufficient to cause the accumulation of relatively large piles of fully or nearly fully overlapping sheets at the leaders of the discrete streams. The accumulations of fully or nearly fully overlapping sheets at the leaders of successive discrete streams can interfere with introduction of discrete streams into the magazines of various processing machines.

U.S. Pat. No. 2,815,949 discloses an apparatus wherein the junction between a preceding elongated path and the next-following elongated paths accommodates a tongue-like flap which can descend into the space between the elongated paths and is located upstream of a belt conveyor. The flap can be moved with the belt conveyor to advance along an arcuate path. One of the aforementioned elongated paths for the scalloped stream is substantially tangential to such arcuate path. When the flap descends, it penetrates into the scalloped stream of paper sheets and causes the oncoming sheets to change the direction of their movement. When the flap has deflected a requisite number of sheets into a selected elongated path, it is retracted upwardly and above the junction, together with the associated belt conveyor (again along the aforementioned arcuate path), so that the scalloped stream can advance in the original direction. A drawback of the just described patented apparatus is that the mass of moving parts (flap and the belt conveyor) is quite substantial so that the speed of the scalloped stream cannot exceed a relatively low value if the flap is to find its way between two neighboring sheets of the travelling stream. Furthermore, the energy requirements of means for moving the relatively large masses along the aforediscussed arcuate path are quite substantial and the system for guiding the flap and the belt conveyor along the arcuate path is complex and expensive.

Swiss patent application Ser. No. 6768/77 discloses an apparatus wherein the junction between several neighboring paths for a scalloped stream includes a step and a conveyor belt which slopes upwardly along and is spaced apart from the step. The gap between the conveyor and the step can be bridged by a tongue-like flap whose mass is small so that it can be caused to rapidly penetrate into the scalloped stream in the region of the step. The arrangement is such that the first stage of movement of the flap into the stream takes place at a high speed. When the flap completes the deflection of a given number of sheets into a different path, the restoration of the original condition (i.e., the travel of sheets into the previously selected path) is effected as follows: the conveyor belt and the step are abruptly lifted in parallelism with the slope of the conveyor belt so that the last sheet of the deflected portion of the scalloped stream is rapidly pulled above the junction. This apparatus allows for rapid changes in the direction of transport of the stream and, therefore, the stream can be advanced at a very high speed. However, the initial as well as maintenance cost of the apparatus is extremely high so that the use of such apparatus in production lines or elsewhere is warranted only under certain exceptional circumstances.

OBJECTS AND SUMMARY OF THE INVENTION

An object of the invention is to provide a novel and improved apparatus which can rapidly divert a scalloped stream from a first path into a selected one of several additional paths and is much simpler, less expensive and less prone to malfunction than heretofore known apparatus.

Another object of the invention is to provide an apparatus which can subdivide a continuous stream of partly overlapping paper sheets or the like into discrete streams without attendant accumulation of numerous fully or nearly fully overlapping sheets at the leading ends of the discrete streams.

A further object of the invention is to provide an apparatus of the above outlined character which can be installed in many existing sheet processing plants as a superior substitute for heretofore known apparatus for diversion of a scalloped stream from a first path into any one of several different paths.

An additional object of the invention is to provide the apparatus with novel and improved means for diverting paper sheets or the like from a first path into any one of several additional paths.

A further object of the invention is to provide the apparatus with novel and improved means for preventing undue accumulations of sheets at the junction between a preceding (first) path and two or more next-following (additional) paths.

Another object of the invention is to provide the apparatus with novel and improved means for rapidly actuating various mobile components which are installed at or close to the junction between several paths.

A further object of the invention is to provide the apparatus with novel and improved means for transmitting motion from a prime mover to one or more mobile components serving to engage and/or deflect paper sheets or the like during transport from a preceding path into a selected one of several additional paths.

The invention is embodied in an apparatus for manipulating a stream of partially overlapping sheets, particularly a scalloped stream of imprinted paper sheets. The apparatus comprises first, second and third transporting units which respectively define elongated first, second and third paths. The first and second paths are preferably horizontal, aligned (coplanar) with each other and separated by a gap having a width of 5–30 centimeters. The third path has a receiving end adjacent to the gap and this third path slopes downwardly so as to make a first oblique angle with the first path and a second oblique angle with the second path. The discharge end of the first path is adjacent to the gap, and so is the receiving end of the second path. The first transporting unit comprises one or more endless chain or belt conveyors or analogous means for advancing the stream along the first path toward the gap, the second transporting unit comprises analogous means for advancing the stream along the second path in a direction away from the gap, and the third transporting unit comprises analogous means for advancing the stream along the third path in a direction away from the gap.

The apparatus further comprises a pivotable flap or an analogous switching device which is installed in the region of the gap and means for moving the switching device between first and second positions. In the first position, the switching device bridges at least a portion of the gap and allows the stream to advance from the first path along the switching device and into the second path. In the second position, the switching device blocks the advancement of the stream from the first into the second path but allows the stream to advance from the first into the third path.

Still further, the apparatus comprises mobile intercepting means disposed in the region of the discharge end of the first path, and actuating means for moving the intercepting means across the discharge end to temporarily prevent the advancement of the stream beyond the first path preparatory to advancement of sheets from the first path into one of the second and third paths (normally during switchover from advancement of the stream into the second path to advancement of the stream into the third path).

If the first and second paths are horizontal or nearly horizontal, the switching device stands above the first and second paths when it assumes its second position. A sheet guiding surface of the switching device is coplanar or nearly coplanar with the first and second paths when the switching device is held in the first position.

The actuating means is designed to move the intercepting means across or away from the first path within an interval of time which is preferably a small fraction of one second (e.g., in the range of a few milliseconds).

If the switching device is or resembles a pivotable flap, it is pivotable between the first and second positions about a preferably horizontal axis which extends transversely of the first and second paths and is adjacent or very closely adjacent to the receiving end of the second path. Thus, the flap extends between such pivot axis and the discharge end of the first path when the moving means is caused to pivot the flap to the first position.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a fragmentary schematic side elevational view of an apparatus which embodies the present invention, the switching device being held in the first position so that a scalloped stream of paper sheets can advance from the first into the second path;

FIG. 2 shows the structure of FIG. 1 with the switching device in its second position and the intercepting means in the operative position so that a sheet is held against movement beyond the first path;

DESCRIPTION OF THE PREFERRED EMBODIMENTS

Figure 3:
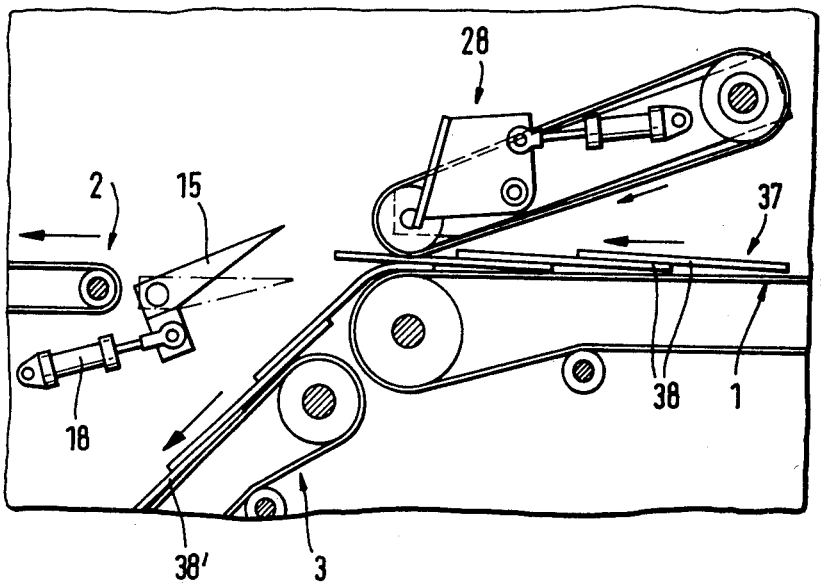
FIG. 3 shows the structure of FIG. 2 but with the intercepting device in the inoperative position so that the stream can advance from the first into the third path.

Referring first to FIG. 1 there is shown an apparatus which comprises a first transporting unit 1 including an advancing means in the form of an endless belt conveyor 4. The upper reach 4*a* of the conveyor 4 defines a first elongated horizontal path P1 for a continuous scalloped stream 37 of partly overlapping paper sheets 38. The belt conveyor 4 can be replaced by a set of narrower belt conveyors which are disposed in parallel vertical planes, or by one or more endless chain conveyors. The discharge end of the path P1 is located in the region of a pulley 7 which is driven by a horizontal shaft 8. The latter receives motion from a suitable prime mover (not shown), e.g., a variable-speed electric motor. If the belt conveyor 4 is replaced by a set of narrower belt conveyors or by one or more endless chains, the pulley 7 can be respectively replaced by a set of discrete coaxial pulleys (one for each narrower belt conveyor) or by one or more sprocket wheels.

A second transporting unit 2 of the apparatus which is shown in FIG. 1 comprises an advancing means in the form of an endless belt conveyor 5 which is trained over several pulleys one of which is shown at 9. The pulley 9 is rotatable on or is driven by a shaft 10, depending upon whether or not the latter is connected with a prime mover. The upper reach 5*a* of the belt conveyor 5 defines a second elongated horizontal path P2 which is coplanar or at least nearly coplanar with the path P1 and is separated from the discharge end of the path P1 by a relatively narrow clearance or gap 11. The width of this gap is preferably in the range of 5 to 30 centimeters, depending upon the length of individual sheets 38 and on the extent of overlap between neighboring sheets of the scalloped stream 37.

A third transporting unit 3 of the illustrated apparatus comprises a sheet advancing means in the form of an endless belt conveyor 6 which is trained over several pulleys 12 one of which is shown in the drawing. The pulley 12 is rotatable on a horizontal shaft 13 which is adjacent to and mounted at a level below the gap 11. The upper reach 6*a* of the belt conveyor 6 defines an elongated third path P3 having a receiving end in the region of the gap 11. The third path P3 slopes downwardly and makes an acute (first oblique) angle with the path P2 and an obtuse (second oblique) angle with the path P1. It goes without saying that the belt conveyor 5 and/or 6 can also be replaced with a set of two or more narrower belt conveyors or with one or more endless chain conveyors. The path P3 is substantially tangential to the pulley 7 for the belt conveyor 4. The speed of the belt conveyor 4 (whose upper reach 4*a* advances the stream 37 in the direction of the arrow A1) matches the speed of the conveyors 5 and 6. The upper reaches of the conveyors 5 and 6 respectively advance in the directions which are indicated by the arrows A2 and A3.

The apparatus further comprises a switching device 15 which is installed in the gap 11 and is movable between a first position which is indicated in FIG. 1 by solid lines and a second position which is indicated by phantom lines, as at 15'. In the second position, the switching device 15 extends upwardly above the level of the common plane of the paths P1 and P2 so that it prevents the sheets 38 of the stream 37 from advancing beyond the discharge end of the path P1, across the gap 11 and into the path P2. At such time, the sheets 38 of the stream 37 can advance from the path P1 into the path P3.

The illustrated switching device 15 is a substantially wedge-like flap which is pivotable about the axis of a horizontal shaft 14 extending transversely of the paths P1 to P3 and mounted in the frame of the apparatus (the frame is not specifically shown) in close proximity to the receiving end of the path P2, i.e., close to the pulley or pulleys 9. The upper side or surface 15*a* of the switching device 15 constitutes a bridge which spans a substantial portion of (but need not span the entire) gap 11 between the paths P1 and P2 when the switching device is held in the first position. This enables successive sheets 38 of the stream 37 to rapidly advance along the surface 15*a* and into the path P2. It will be noted that, when in the first position, the switching device 15 extends from the shaft 14, i.e., from the region of the receiving end of the path P2, toward the discharge end of the path P1. Otherwise stated, the unattached end portion or tip of the wedge-like switching device 15 is near to the pulley 7 when the switching device is maintained in that (first) position in which the stream 37 is free to advance from the path P1 into the path P2.

It is preferred to use a hollow switching device 15 and/or to make such switching device of a lightweight metallic or plastic material so that its mass is small or negligible. This enables a moving means including a fluid-operated motor 18 to abruptly pivot the switching device 15 from the first to the second position or vice versa. The motor 18 is preferably a double-acting pneumatic cylinder and piston unit. The conduits which connect the chambers of the cylinder and piston unit 18 with suitable valve means which, in turn, can connect a selected chamber with a source of pressurized fluid or with the atmosphere (if the fluid is air) are not shown in the drawing. The cylinder of the unit 18 is articulately connected to the frame by a stationary pivot pin 19, and the piston rod 18*a* of the unit 18 is articulately connected via a pivot pin 17 with a relatively short link 16 which is rigid with the switching device 15 and is turnable about the fixed axis of the shaft 14. The link 16 constitutes an accelerating device which enables the unit 18 to pivot the switching device 15 to the one or the other position within a surprisingly short interval of time, e.g., within an interval of a few milliseconds. It has been found that the illustrated moving means 18, 19 can readily pivot the switching device 15 to either of its positions within an interval of approximately 15 milliseconds. The length (indicated in FIG. 2, at 20) of the switching device 15 exceeds the effective length 21 of the link 16; this enables the link 16 to multiply the speed of movement of the switching device 15 to the solid-line or phantom-line positions of FIG. 1. It has been found that the utilization of a relatively short link 16 in combination with a rapidly reacting fluid-operated cylinder-and-piston unit entails or allows for practically instantaneous changes in the angular position of the switching device 15 with reference to the axis of the shaft 14.

As stated above, the length 20 of the switching device 15 need not equal (and need not even approximate) the width of the gap 11. All that counts is to ensure that the tip of the switching device 15 (in the solid line position of FIG. 1) is sufficiently close to the pulley 7 to intercept the oncoming sheets 38 of the stream 37 so that the leaders of such sheets are not flexed downwardly and below the tip of the switching device 15 before they advance across the relatively narrow, or even relatively wide, clearance between the discharge end of the path P1 and the upper side or surface 15*a* (provided that this surface is located in the common horizontal plane of the paths P1 and P2).

Still further, the improved apparatus comprises a mobile intercepting device 28 which is located at a level above the path P1 and can be moved between the operative position of FIG. 2 (in which it extends transversely across the discharge end of the path P1 to temporarily intercept the nearest sheet 38') and the inoperative position of FIG. 1 in which the sheets 38 of the stream 37 are free to advance along the path P1, over the surface 15*a* and into the path P2. The intercepting device 28 is mounted on a carriage or carrier including one or more levers 24 pivotable about the fixed axis of a horizontal shaft 25 extending transversely of the path P1 and located at a level above such path at a locus at least slightly remote from the pulley 7. The carrier including the lever or levers 24 further supports the shaft 23 for one or more pressing rollers 22 which form part of an auxiliary conveyor for the stream 37. The rollers 22 are preferably rotatable with reference to the shaft 23. If desired, the rollers 22 can be rotated by the sheets 38 of the stream 37, i.e., directly by the belt conveyor or conveyors 4 of the transporting unit 1. Alternatively, and as shown in the drawing, the roller or rollers 22 of the auxiliary conveyor can be positively driven by a separate drive so that their peripheral speed matches the speed of the upper reach 4*a*. The drive means includes a driven pulley 26 on the shaft 25 (the shaft 25 may constitute a component part of the means for rotating the pulley 26) and a belt conveyor 27 which is trained over the pulley 26 and roller or rollers 22. It is preferred to employ a carrier which comprises two spaced-apart levers 24 so that the roller or rollers 22 can be installed in the space between such levers. Since the lever or levers 24 of the carrier are free to pivot about the axis of the shaft 25, their weight contributes to the force with which the roller or rollers 22 bear against the upper sides of successive sheets 38 forming part of the stream 37. The belt conveyor 27 can be replaced with two or more narrower belt conveyors (disposed in parallel vertical plane) or with one or more chain conveyors. The direction in which the pulley or pulleys 26 drive the conveyor or conveyors 27 is indicated by the arrow A4. It is preferred to drive the roller or rollers 22 in such a way that their peripheral speed at least closely approximates the speed of the upper reach 4*a*, i.e., the speed of the conveyor or conveyors 27 should equal or nearly equal the speed of the conveyor 4, 5 or 6. The main purpose of the roller or rollers 22 is to ensure that successive sheets 38 of the stream 37 are held in requisite frictional engagement with the upper reach 4*a*, i.e., that the belt conveyor 4 does not slide relative to the underside of the stream 37. This further ensures that the inertia of successive sheets 38 of the stream 37 suffices to cause such sheets to advance along the surface 15*a* and into the path P2 (i.e., into engagement with the upper reach 5*a* of the conveyor 5) when the switching device 15 is maintained in the solid-line (first) position of FIG. 1.

The aforementioned intercepting device 28 is movably mounted on the carrier including the lever or levers 24. This device comprises a blade-like member 31 mounted on a plate-like link 30 which is fulcrumed on the carrier, as at 29, and forms part of the actuating means for the blade 31. The plane of the blade 31 is normal or nearly normal to the plane of the plate-like link 30, and a portion of the blade 31 extends downwardly beyond the lower edge face of the link 30 so as to form a stop 31*a* which can intercept an oncoming sheet 38' in a manner as shown in FIG. 2. The fulcrum 29 is a horizontal pin which is parallel to the shafts 23 and 25, i.e., it extends transversely of the path P1. The link 30 is pivotable about the fulcrum 29 by a fluid-operated motor 33 here shown as a quick-reacting pneumatic cylinder and piston unit. The cylinder of the unit 33 is articulately connected with the carrier (lever or levers 24) by a horizontal pivot pin 34, and the piston rod 33*a* of the unit 33 is articulately connected with the link 30 by a second horizontal pivot pin 32. The blade 31 can be welded or otherwise permanently fastened to the link 30. The controls (valve means) which admit a pressurized fluid into or permit escape of fluid from the chambers of the unit 33 are preferably designed and operable in such a way that the time to pivot the blade 31 between the positions shown in FIGS. 1 and 2 is extremely short, e.g., again in the order of a few (for example, 15) milliseconds. In other words, the blade 31 can be abruptly moved in front of an oncoming sheet 38' forming part of the stream 37 on the upper reach 4*a* of the conveyor 4, and this blade can also be moved, with a minimal loss of time, back to its inoperative position which is shown in FIG. 1. The inertia of the parts 30, 31 is preferably small so as to further enhance the rapid pivoting action of the cylinder and piston unit 33.

The just discussed time can be shortened still further by selecting the distance 35 between the axes of the pivot members 29, 32 (see FIG. 2) in such a way that it is shorter than that (shown at 36) between the pivot member 29 and the projecting portion or stop 31*a* of the blade 31.

The feature that the blade 31 is mounted on the lever or levers 24 of the carrier means for the roller or rollers 22 is desirable and advantageous because this ensures that the distance between the stream 37 and the stop 31*a* (in the inoperative position of the intercepting means 28) is constant irrespective of the height of the stream 37, i.e., the roller or rollers 22 rise on the stream 37 and therefore maintain the stop 31*a* at a fixed distance from the upper sides of successive sheets 38 on the upper reach 4*a* of the belt conveyor 4. This, in turn, allows for disturbance-free transfer of the stream 37 into the path P2 or P3, depending on the position of the switching device 15. Moreover, the sheets 38 are less likely to be damaged or deformed by the blade 31 if the stop 31*a* of this blade is maintained at a fixed distance from the upper side of the stream 37.

The operation of the improved apparatus is as follows:

When the unit 18 maintains the switching device 15 in the (first) position which is shown in FIG. 1 by solid lines, successive sheets 38 of the scalloped stream 37 are free to travel along the surface 15*a* and into the path P2 to be engaged and entrained by the upper reach 5*a* of the belt conveyor 5. The conveyor 5 can deliver the stream 37 to storage or to a processing machine, e.g., in a manner as disclosed in the aforementioned copending application Ser. No. 908,546. The auxiliary conveyor means including the roller or rollers 22 bears against the exposed (not-overlapped) portions of successive sheets 38 at the discharge end of the path P1 and ensures that the sheets 38 cannot slip relative to the conveyor 4 (and/or vice versa), especially since the roller or rollers 22 are preferably driven at a peripheral speed which matches or closely approximates that of the conveyor 4. As mentioned above, the force with which the conveyor 4 and/or the roller or rollers 22 propel successive sheets 38 of the stack 37 in the direction of arrow A1 suffices to guarantee that the sheets 38 slide over the surface 15*a* and enter the path P2 to be entrained by the conveyor 5 whose upper reach 5*a*, too, advances (in the direction of the arrow A2) at the exact speed of the upper reach 4*a*. As mentioned above, the roller or rollers 22 can be driven by the sheets 38 of the stream 37; in such instance, the rollers 22 merely constitute a weight or mass which maintains successive sheets 38 of the stream 37 in requisite frictional engagement with the upper reach 4*a*. If the roller or rollers 22 are positively driven (as shown in the drawing), they form part of an auxiliary conveyor which even more reliably ensures that the sheets 38 can advance along and beyond the surface 15*a* without appreciable reduction of their speed.

If the transfer of successive sheets 38 of the stream 37 from the path P1 into the path P2 is to be interrupted, i.e., if the sheets 38 are to enter the path P3, the controls for the fluid-operated unit 33 receive a signal which causes the unit 33 to pivot the intercepting device 28 from the inoperative or retracted position of FIG. 1 to the operative or intercepting position of FIG. 2. The stop 31*a* of the blade 31 then moves across the discharge end of the path P1 and intercepts the leading edge of the oncoming sheet 38' (see FIG. 2). The sheet 38' which precedes the sheet 38' and is partially overlapped thereby continues to advance in the direction of the arrow A1 because it is engaged by the upper reach 4*a* as well as by the driven roller or rollers 22 so that it is extracted from the space between the upper reach 4*a* and the sheet 38' to be propelled onto and beyond the surface 15*a* of the switching device 15. At the very instant when, or immediately after, the contact between the sheets 38' and 38'' is terminated (i.e., when the trailing end of the sheet 38'' has advanced beyond the intercepted leading edge of the sheet 38'), the unit 33 returns the intercepting device 28 to the inoperative position (see FIG. 3). This means that, at the very most, the device 28 intercepts one sheet 38 in addition to the intentionally intercepted sheet 38'. Therefore, the pileup of overlapping or nearly overlapping sheets 38 at the leading end of that portion of the stream 37 which is about to enter the path P3 is negligible and invariably only a very small fraction of the pileup in conventional apparatus. If the extent to which the sheets 38 of the stream 37 overlap is very pronounced (i.e., if only a relatively small portion of each preceding sheet 38 extends forwardly and beyond the leading edge of the next-following sheet 38 of the scalloped stream 37), the blade 31 might intercept as many as two sheets in addition to the sheet 38', i.e., in addition to the intentionally intercepted sheet. This is shown in FIG. 2 and can be considered as the worst possible mode of operation of the improved apparatus, i.e., as a rule, the number of sheets 38 which pile up on the intentionally intercepted sheet 38' is not in excess of one. Even though the sheet 38' may be fully or nearly fully overlapped by two sheets 38, this still does not amount to a genuine pileup of sheets 38 at the leading end of that portion of the stream 37 which is about to enter the path P3. Such a "pileup" is not only unlikely but normally incapable of interfering with further processing of the stream portion which enters the path P3.

Figure 4:
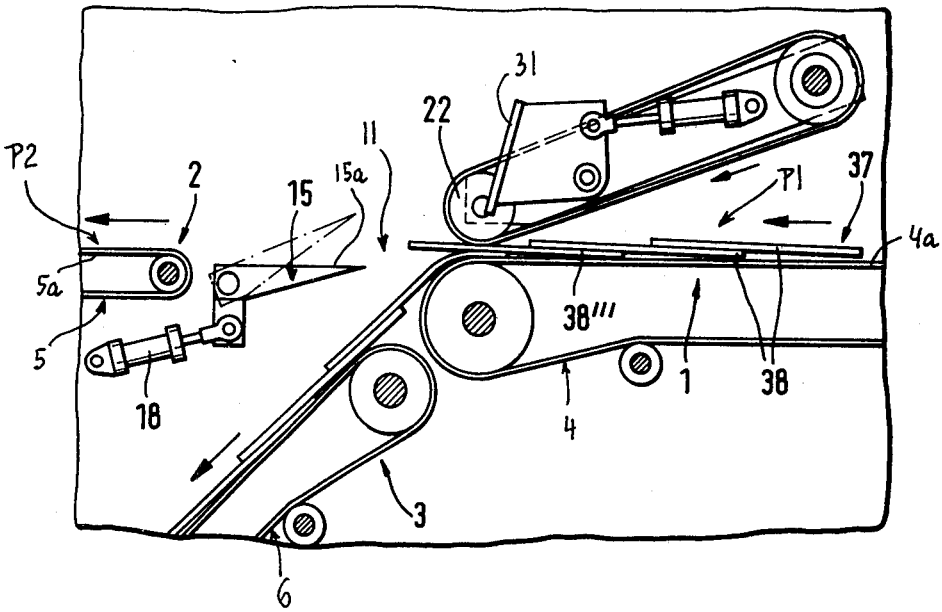
FIG. 4 shows the structure of FIG. 3 but with the switching device back in the first position ready to steer an oncoming sheet into the second path.

The cylinder and piston unit 18 moves the switching device 15 to the second position (shown in FIG. 2) as soon as the trailing end of the sheet 38'' advances beyond the path P1. In such second position of the switching device 15, its underside 15*b* promotes the movement of the leader of the next-following portion of the stream 37 into the path P3. The sheet 38' (together with the next-following sheets 38 of the stream 37) is free to advance from the path P1 into the path P3 when the blade 31 is lifted to the inoperative position of FIG. 3. The path P3 can lead to the magazine of a gathering or other machine, not shown. When the magazine is filled to capacity or to a desired degree, the apparatus reverts to transport of sheets 38 from the path P1 into the path P2, preferably in response to a signal which is generated (e.g., in a manner as disclosed in the copending application Ser. No. 908,546) when the path P3 has received and delivered a requisite number of sheets 38. This reversion to transport of sheet 38 from the path P1 into the path P2 does not necessitate a renewed shifting of the intercepting device 28 and its blade 31 to the operative position. It suffices to actuate the moving means 18, 19 for the switching device 15 so that the latter returns to the first position by moving its tip downwardly and into the path of the oncoming sheet 38''' (see FIG. 4). The leader of the oncoming sheet 38''' is then intercepted by the tip of the switching device 15 and travels along the surface 15*a* into the path P2. The next-following sheets 38 of the stream 37 follow automatically, i.e., such sheets 38 also slide along the surface 15*a* and advance onto the upper reach 5*a* of the belt conveyor 5 in the transporting unit 2. The roller or rollers 22 cooperate with the upper reach 4*a* of the conveyor 4 to propel successive sheets 38 of the stream 37 across the gap 11 (which is partially bridged by the switching device 15) and into the path P2.

The switching device 15 is returned to the second position (FIG. 2) when a monitoring device for the magazine which receives sheets 38 from the conveyor 6 transmits a signal denoting that the magazine is in need of a fresh supply of sheets 38. The aforedescribed sequence of steps is then repeated, i.e., the blade 31 is abruptly moved to its operative position and the switching device 15 is pivoted so that its tip extends to a level above the common plane of the paths P1 and P2.

An important advantage of the improved apparatus is that its lightweight switching device 15 and its lightweight intercepting means 28, in combination with the rapidly reacting units 18 and 33, allow for surprisingly quick shifting from the transport of sheets 38 into the path P2 to transport of sheets 38 into the path P3 or vice versa. Moreover, such shifting can be effected without the formation of a wide space between the trailing end of the stream portion which has been delivered into the path P2 and the leader of the next-following stream portion which is about to enter the path P3 (or vice versa). In fact, the width of such space can be held at or close to zero. Still further, such reduction of the width of spaces between successive stream portions can be achieved regardless of the speed of the stream 37, i.e., the stream can be readily transported at an elevated speed which is desirable in many modern sheet processing plants. Thus, the junction between the paths P1, P2 and P3 does not constitute a bottleneck in the production line in which the improved apparatus is put to use. Furthermore, the stream 37 can be subdivided into shorter streams which are delivered into the path P2 or P3 without the accumulation of fully or nearly fully overlapping sheets 38 at the leading ends of such shorter streams, even if the scalloped stream 37 is of such configuration that the extent of overlap between neighboring sheets 38 is quite substantial. In addition, a switchover from the delivery of sheets 38 into the path P3 to the delivery of sheets 38 into the path P2 does not necessitate any relative shifting of neighboring sheets 38 of the stream portion which is about to reenter the path P2 because the intercepting device 28 must be moved to its operative position only when the apparatus is to divert sheets 38 from the path P1 into the path P3 instead of into the path P2. In other words, the apparatus does not exhibit the slightest tendency to accumulate fully or nearly fully overlapping sheets 38 at the leader of the stream portion which is about to enter the path P2 (subsequent to pivoting of the switching device 15 from the second to the first position). This is also attributable to the aforediscussed feature that the intercepting means 28 must be moved to its operative position when and only when the stream 37 (whose sheets 38 are being delivered from the path P1 into the path P2) is to be diverted into the path P3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. Apparatus for manipulating streams of articles, particularly streams of partly overlapping sheets, comprising:

(a) a first transporting unit for a stream of articles;

(b) a second transporting unit for the stream defining a gap with said first unit, said first unit having a discharge end adjacent said gap and being operative to advance the stream towards said gap, and said second unit having a receiving end adjacent said gap and being operative to advance the stream away from said gap;

(c) a third transporting unit for the stream having a receiving end adjacent said gap and being operative to advance the stream away from said gap;

(d) a switching device installed in said gap and having a free end which faces said first unit and is movable between a first position in which said device bridges at least a portion of said gap and allows the stream to advance from said first to said second unit and a second position in which said device blocks the advancement of the stream to said second unit but allows the stream to advance from said first to said third unit;

(e) means for moving said device between said first and second positions;

(f) intercepting means movable to and from an intercepting position in which said intercepting means temporarily prevents the advancement of articles beyond said discharge end; and (g) actuating means for moving said intercepting means to and from said intercepting position, said actuating means being operative to move said intercepting means into said intercepting position when said device is to move from said first to said second position but not when said device is to move from said second to said first position.

2. The apparatus of claim 1, wherein said first and second units define substantially horizontal paths and said switching device extends above said first and second paths in said second position thereof.

3. The apparatus of claim 1, wherein said switching device has a guiding surface which is substantially coplanar with said first and second units in said first position of said switching device.

4. The apparatus of claim 1, wherein said actuating means includes means for moving said intercepting means to or from said intercepting position within an interval of time which is a small fraction of one second.

5. The apparatus of claim 4, wherein said interval is within the range of a few milliseconds.

6. The apparatus of claim 1, wherein said switching device includes a flap which is pivotable between said first and second positions.

7. The apparatus of claim 1, wherein said switching device is pivotable between said first and second positions about an axis extending transversely of said first and second units and located adjacent to said second unit so that said switching device is disposed between said axis and said discharge end in said first position thereof.

8. The apparatus of claim 1, comprising auxiliary conveyor means disposed in the region of said gap and including means for advancing successive articles of the stream along said switching device and to said second unit in said first position of said switching device.

9. The apparatus of claim 8, wherein said auxiliary conveyor means comprises at least one rotary member and means for biasing said rotary member against successive articles of the stream opposite said first transporting unit.

10. The apparatus of claim 9, comprising means for driving said first transporting unit at a predetermined speed, said rotary member being arranged to rotate at a peripheral speed which at least approximates said predetermined speed.

11. The apparatus of claim 10, wherein said rotary member is rotated by the stream in said first unit.

12. The apparatus of claim 10, comprising drive means for said rotary member.

13. The apparatus of claim 9, wherein said biasing means comprises carrier means for said rotary member, said carrier means being pivotable about an axis which extends transversely of and is disposed above said first unit.

14. The apparatus of claim 13, wherein said carrier means comprises at least one lever and said axis is substantially horizontal.

15. The apparatus of claim 1, wherein said actuating means comprises a fluid-operated motor.

16. The apparatus of claim 15, comprising link means interposed between said motor and said intercepting means.

17. The appratus of claim 13, wherein said rotary member is journalled in said carrier means.

18. The apparatus of claim 1, wherein the width of said gap is between 5 and 30 centimeters.

19. The apparaus of claim 1, wherein said means for moving said switching device includes fluid-operated motor means.

20. The apparatus of claim 1, wherein said first and second units are aligned with one another.

21. The apparatus of claim 1, wherein said third unit defines a downwardly sloping path.

22. The apparatus of claim 1, wherein said units respectively define elongated first, second and third paths and said third path makes oblique angles with said first and second paths.

23. The apparatus of claim 1, wherein said intercepting means is located in the region of said discharge end.

24. The apparatus of claim 1, wherein said free end is located externally of said units in said first and second positions thereof.

* * * * *